United States Patent [19]

Evans

[11] 4,258,828

[45] Mar. 31, 1981

[54] FOLDING MAST LADDER

[76] Inventor: Ronald K. Evans, 834 W. Montecito Way, San Diego, Calif. 92103

[21] Appl. No.: 68,706

[22] Filed: Aug. 22, 1979

[51] Int. Cl.[3] ..... B63B 29/20

[52] U.S. Cl. ..... 182/95; 182/100; 182/156

[58] Field of Search ..... 182/95, 96, 100, 189, 182/156

[56] References Cited

U.S. PATENT DOCUMENTS

| | | | |
|---|---|---|---|
| 646,291 | 3/1900 | Krueger | 182/189 |
| 928,478 | 7/1909 | Smalley | 182/189 |
| 1,719,997 | 7/1929 | Pirsch | 182/189 |
| 1,831,332 | 11/1931 | Wagner | 182/95 |
| 2,148,099 | 2/1939 | Bray | 182/189 |
| 4,132,288 | 1/1979 | Bingham | 182/100 |
| 4,139,079 | 2/1979 | Clark | 182/100 |

*Primary Examiner*—Reinaldo P. Machado
*Attorney, Agent, or Firm*—Charmasson, Branscomb & Holz

[57] ABSTRACT

A folding ladder entirely contained within a U-shaped channel is mounted in a sailboat mast and can be folded and stowed in a flush position, avoiding protruding surfaces on the circumference of the mast. A sliding bar is contained within the U-shaped channel containing a plurality of bracket protrusions which support a swivel pin which in turn support a brace bar connected to a foot bar. One end of the foot bar is fixed to the wall of the U-shaped channel. When the slide bar is moved downward the movement of the brace bar attached to the bracket protrusions extends each step bar forming a series of triangularly supported ladder steps.

7 Claims, 14 Drawing Figures

45'
41
45
40
39
43
44
42
44'
8
13
14
11
12
10
20
22
21
30
39A
62
70
72
81
48
46
47
49
6
7

FOLDING MAST LADDER

BACKGROUND OF THE INVENTION

For the hundreds of years that sail power has been used to propel boats, there has always been a need for access to the top of the masts which support the sails. The sailing, rigging and supporting structures frequently require maintenance and repairs, sometimes in critical circumstances, such as during bad weather or while racing. However, the limited space available around the mast and rigging has precluded use of conventional devices such as ladders and the danger involved in ascending to a precarious position atop a tall mast requires safety considerations which compound the problem.

Traditional means of access to the top of boat masts has included permanent rope ladders as a part of the rigging, or a chair or sling attached to a pulley at the top of the mast. The ladder devices are known as bosun's chairs and are widely used because they can use existing rigging which is otherwise used to haul up the sails. The danger involved in use of a bosun's chair however, limits its use during underway condition, and is time consuming in any conditions.

Other devices have appeared in the art such as fixed steps on the mast and extending devices that must be hoisted up the mast. The disadvantage of fixed devices is that their protrusions interfere with the operation of the rigging and with the airflow around the mast. Airflow disturbances can be critical and aerodynamic qualities of the mast shape itself are important in racing design.

OBJECT AND SUMMARY OF THE INVENTION

The present invention embodies a design for a folding ladder which can be stowed flush within the shape of the mast. Since masts are commonly formed of metal extrusions of hollow cylindrical or oval shape the enclosure for the ladder can be indented within the shape of the mast during the extrusion process. The present invention can be folded into a very small linear shape and thus requires only a small extruded indentation in the form of a lengthwise channel. A similar channel could be formed in a wooden mast by routing the lengthwise channel. A U-shaped enclosure is placed within the mast channel, enclosing in turn a sliding bar. Triangular steps extend from the channel, the bottom side of the triangle being a foot bar. The brace bar forms the hypotenuse of the triangle attached at its upper end to a swivel joint mounted on the sliding bar. As the sliding bar is drawn upward the brace bar is drawn into the channel and in turn draws the horizontal foot bar into the vertical position within the channel. Thus the entire step or series of steps is drawn into the U-shaped channel and can be retained in that position until needed. The folding ladder device is most conveniently used in a spaced pair which the mast can easily accommodate since each device is quite small, of course the ladder device here described may have other applications in addition to its marine application, such as a folding fire-escape or for permanent installation of the ladder in a confined space.

Thus, it is an object of the within invention to provide a folding ladder device which can provide quick access to the top of a sailboat mast with the required degree of safety.

Another object is to provide a ladder for access to the top of a sailboat mast which will not interfere with the shape or function of the mast.

Another object is to provide ladder means integral to a sailboat mast which will not increase wind resistance or interfere with the aerodynamic shape of the mast.

Another object is to provide a ladder which can be folded and stowed in a very small space and which will be of very light weight.

A final object of the within invention is to provide a rigid, extendable ladder which can provide permanent vertical access in confined spaces.

DETAILED DESCRIPTION OF PREFERRED EMBODIMENT

Figures 1, 2, 3, 4, 5, 6, 7, 8, 9:
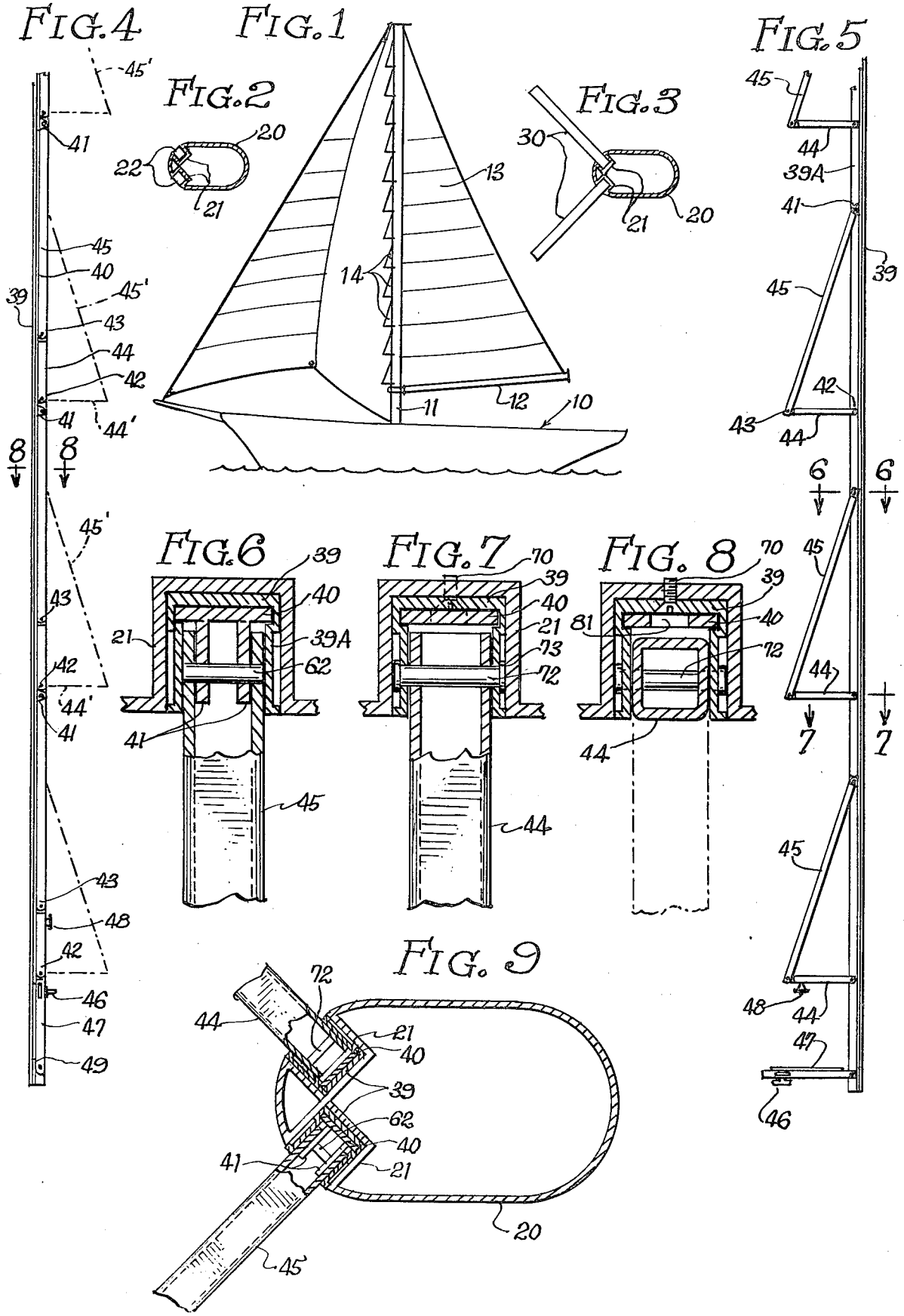
FIG. 1 is a representational view of a sailboat with the ladder installed and extended.
FIG. 2 is a cross-section of a mast extrusion including ladder channels and showing the ladder in folded position.
FIG. 3 is a cross-section of a mast extrusion with ladder channels showing the ladder extended.
FIG. 4 is an interior view of the ladder components in folded position.
FIG. 5 is an interior view of the ladder components in extended position.
FIG. 6 is a cross-section on line 6—6 of FIG. 5 detailing the slide-joint in extended position.
FIG. 7 is a cross-section on line 7—7 of FIG. 5 detailing the fixed-joint in the extended position.
FIG. 8 is a cross-section on line 8—8 of FIG. 4 detailing the ladder in stowed position.
FIG. 9 is a expanded cross-section of the mast and ladder components.

FIG. 1 illustrates the concept of the within invention in use on a sailboat shown in typical form 10 including a typical mast 11 which supports boom 12 and sail 13 through a rigging arrangement of lines and pulleys. A pair of ladder devices each comprised of a series of steps 14 extends throughout the length of the mast and affords access from the deck to the top of the mast for repairs and maintenance on fouled rigging and the like. In a modern sailboat the mast consists of a metal extrusion of a constant cross-section from bottom to top.

FIG. 2 illustrates such a hollow extrusion showing the mast to be of a generally oval cross-section 20. Extruded along the length of the mast are channels 21 of generally rectangular cross-section open to the surface of the oval in order to contain the ladder structure 22 as it is described following. For simplicity other features of the mast are not shown on these drawings, such as the sail track which would be an additional extruded channel on the aft surface of the mast and cleats and pulleys which would be attached to the mast for rigging the sails.

FIG. 3 shows the same cross-section with the ladder in extended position at the forward curvature of the oval, the steps are angularly separated by 90° or more in order that the user when climbing the ladder alternately places his left foot bar 40. The bar extends throughout the length of the channel except for a short length at the bottom of the channel which permits movement of the slide bar. The slide bar in turn supports a series of ear-like bracket protrusions 41 which are attached to the upper end of the brace bar 45 via a clevis pin. Each brace bar 45 is attached at its lower end to the step rung 44 at the step joint 43. At the other end of the step bar is attached to a fixed joint 42 by another pin which permits it to swivel around that point. As slide bar 40 moves downward, it moves the ears 41 downward with it and the attached upper end of the brace bar 45. Since fixed joint 42 does not move with the slide bar, the step joint 43 at the lower end of the brace bar must move outward moving the step rung to a horizontal position. A stop at 49 is fitted into the channel at its bottom preventing further movement of the slide bar at the point where the step rungs reach the horizontal position shown in shadow view as 44'. The brace bar is shown in shadow view in its extended position at 45'. Reversing the operation to move the slide bar upward would obviously withdraw the triangular steps back into the enclosing channel and the mechanism can be secured in its up position by raising stop bar 47 into a vertical position preventing downward movement of the slide bar. The stop bar can be secured by latch 46. Finally, knob 48 is provided for starting the ladder into its downward movement when stop bar 47 is withdrawn.

FIG. 5 illustrates more clearly the ladder as a series of rigid triangles in its extended position and revealing that the ladder channel 39 also includes sidewall 39A to which one end of ladder rungs 44 are affixed at joint 42. It may readily be seen in this view that the user inserts his foot in sequence into each triangular ladder step formed, which prevents the user's foot from dangerously slipping from the rung during rough conditions.

Line 6—6 in FIG. 5 cuts across the sliding joint formed by the upper end of the brace bar attached by pin to the bracket of the slide bar. FIG. 6 illustrates this joint in detail disclosing the generally U-shaped cross-section of the ladder channel 39. The actual shape of the ladder channel, also typically a metal extrusion, encloses the slide bar 40, which in turn supports the protruding brackets 41. The brace bar formed of square metal stock 45 fits closely at its upper end over the brackets 41 and is attached by clevis pin 62; when weight is placed on the step rung the weight is transmitted through the brace bar to the clevis pin which would exert an outward force on the brackets and the slide bar. The indented sides 39A of the U-shaped extrustion 39 serve to prevent the slide bar from being withdrawn outward of the channel and maintains the vertical rigidity of the entire structure.

FIG. 7 is a detailed cross-section of a fixed joint and shows the step bar in extended position. The mast channel 21 enclosing the ladder channel 39 is again disclosed and flat slide bar 40 is contained within the ladder channel. At this point the inside end of step rung 44, also of hollow square stock, is attached to the side wall of the ladder channel via swivel pin 72 which is held in position by flange 73. This view also discloses that the ladder channel 39 is affixed to the mast channel 21 by retaining screws 70.

A cross-sectional view of the ladder in its collapsed or stowed position is revealed in FIG. 8. Again the mast channel 21 enclosing the ladder channel 39 and slide bar 40 is revealed; parenthetically at the point of this cross-section the slide bar 40 contains an opening 81 for access to the retaining screws 70. The section cuts through the brace bar showing clearly the rectangular bar stock 44 in the folded position and all of the ladder components within the mast channel 21, presenting a flush surface to the outside.

FIG. 9 is an expanded view of the mast cross-section showing the relationship of the ladder components. Since the right and left ladders of the pair are staggered in order to facilitate climbing, the cross-section at this view cuts through the slide joint in extended position showing the brackets 41 supporting the brace bar 45 similar to the view of FIG. 6 and a fixed joint similar to the view of FIG. 7 showing the horizontally extended ladder rung 44 attached to the ladder channel via rung pin 72.

Figure 10:
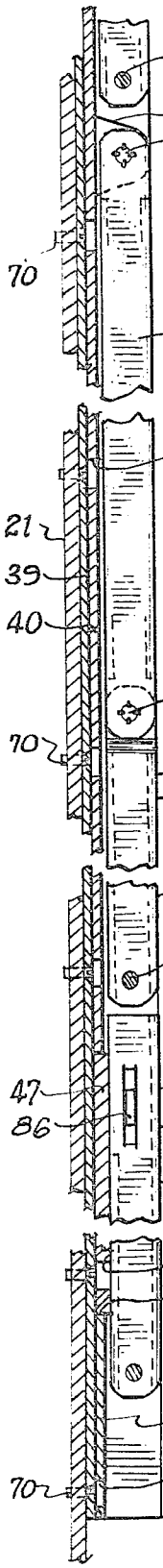
FIG. 10 is a side-view cross-section of the ladder channel with the ladder in stowed position.

The remaining figures show in further detail the components of the ladder. FIG. 10 shows the ladder in stowed position in relation to the slide bar 40, ladder channel 39 and mast channel 21, shown in cross-section. The brace bar and the step rung can be seen in this view to swivel around the three pin connections as they are extended and folded. The bracket 41 is attached to the upper end of the brace bar 45 by pin 62; the brace bar 45 and step rung 44 are attached at the extending ends by pin 75 and the other end of the step rung fixed in relation to the ladder channel is supported by pin 72. More clearly seen in this view is the stop bar 47 which in its stowed position closely fits under the lower end of the slide bar 40 preventing its downward travel and thus holding the ladder in stowed position. The stop bar 47 is held in place by latch 46. Also more visible in this view is the access holes 81 through which the ladder channel is attached to the mast channel.

Figure 11:
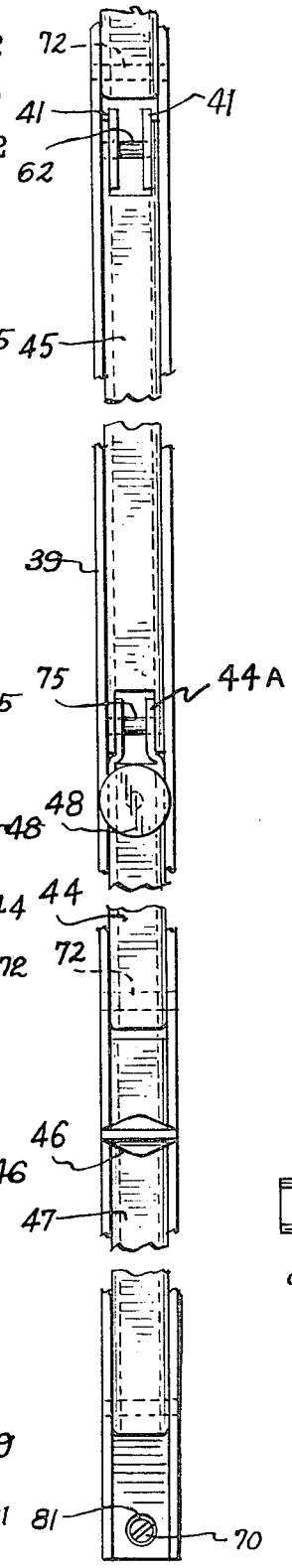
FIG. 11 is a front view of the ladder in stowed position corresponding to FIG. 10.

FIG. 11 is a front view corresponding to the side view of FIG. 10 and further disclosing the relationship at the juncture of step rung 44 and brace bar 45. Since both bars are comprised of square stock of the same dimension it is necessary to crimp the end of step rung 44 as shown at 44A to fit inside the end of brace bar 40. The downward travel of the slide bar continues until it engages the lower stop 82 at the fully extended position of the ladder.

Figure 12:
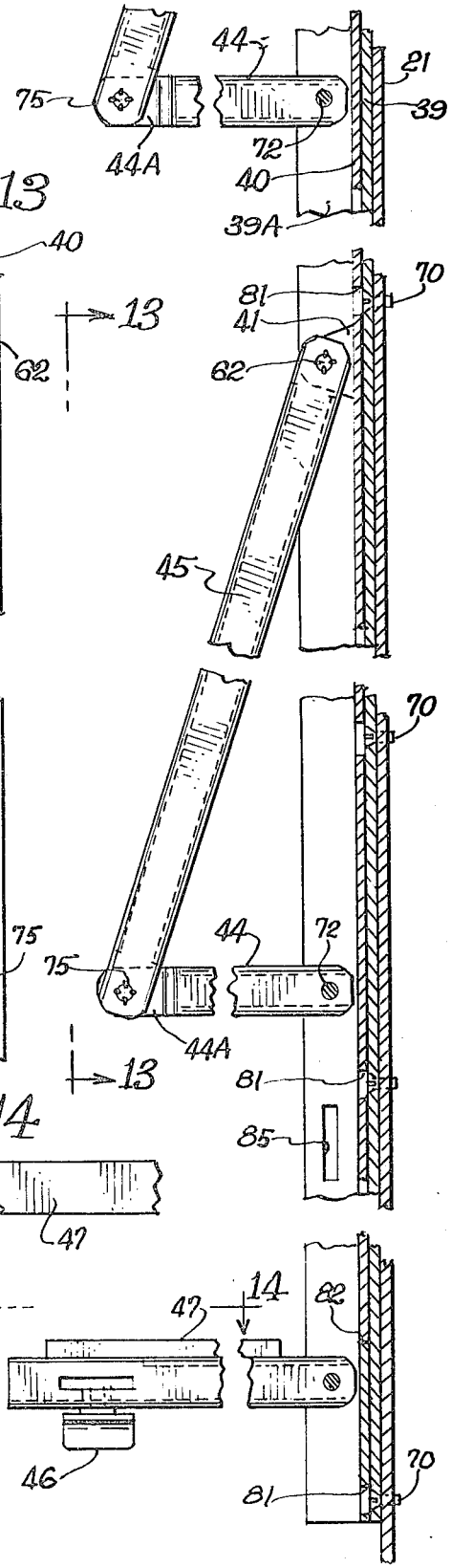
FIG. 12 is a side-view cross-section of the ladder channel with the ladder in extended position.

FIG. 12 is a side view cross-section corresponding to the views of FIGS. 10 and 11 but showing the components in extended position. Slide bar 40 is shown in its lowered position limited by lower stop 82 inside the channel. The stop bar 47 has been lowered completely away from the ladder having been removed to allow extension. The rigid configuration of the step can be observed in this view. The foot bar which supports it is in its fully lowered position. Thus the triangle formed by the brace bar, foot bar 45 could be replaced by a length of flexible cable formed to an eye at each end for placement around pins 62 and 75. The replacement of the rigid bar with a steel cable would not affect the rigidity or strength of the supporting triangle formed since the users weight on the step rung would keep the triangle fully extended.

Also to be noted in this view is that the spacing between the elements of each step must be at least equal to the combined lengths of the foot bar 45 in order to fully contain them in their collapsed position inside the channel.

Figure 13:
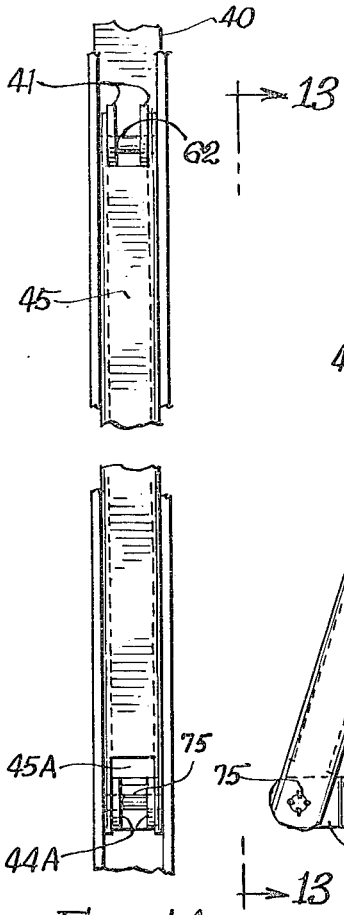
FIG. 13 is a front view of a step in extended position corresponding to FIG. 12.
Figure 14:
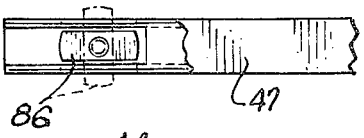
FIG. 14 is a top view of the bottom step detailing the latch mechanism.

FIG. 13 corresponds to FIG. 12 and shows the extended step from a front view, and particularly that the cut-away portions of the ends of support link 45 allow the rotation of the end of the link 45A relative to the crimped end of the foot bar in its raised position. Rotating dog 86 will engage slot 85 shown on FIG. 12 in the side wall of the ladder channel and will prevent the stop bar from disenagaging. When the latch handle 46 is rotated, in turn rotating dog 86 to a position parallel to the stop bar 47, the bar may be lowered and the ladder lowered to the extended position.

Finally, it should be clear that the ladder as it has been described could be adapted to many other uses than the embodiment discussed for a sailboat mast. The entire ladder mechanism is contained in its U-shaped channel and the channel can be affixed by the screw holes to any extended vertical surface where access may be facilitated thereby. The installation may either be in a formed channel such as described in the mast extrusion or upon the external surface of a wall or the like. Although the length of the ladder is theoretically unlimited, it would be more convenient to manufacture the ladder in convenient sections and provide that the sections may be joined together to the desired vertical height. The only interconnection between such elements would be means of connecting the ends of the slide bar from the lower end of an upper section to the top end of a slide bar in the next lower section. Thus the concept may be applied without limitation through any vertical distance.

What is claimed is:

1. A folding ladder device comprising:

a sailboat mast to which is affixed one or more vertical channel bars substantially U-shaped in cross-section each vertical channel bar slidably containing a substantially flat rigid bar said flat bar containing at intervals a plurality of bracket protrusions which each support a hinge pin, a support link rotatably affixed to each hinge pin such that each link will rotate from a stowed position within the channel bar to an extended position protruding from the channel bar, a rigid foot rung shorter than said support links attached at one end rotatably by a rung pin the extending end of each support link and at the other end rotatably to and within the channel bar by a fixed pin the distance between the fixed pin attachments being more than the combined links of the foot rung and support link, a stop placed within the channel bar at the base of said ladder which limits the downward vertical travel of the slidable flat bar to a distance of one foot rung length such that when extended the ladder device enables access from the bottom to the top of the mast, and means to retain the ladder device in a raised stowed position.

2. The device of claim 1 wherein the sailboat mast further contains one or more lengthwise channels each of which closely contain the said vertical channel bar such that the ladder device in its stowed position will be entirely flush with the surface of the mast.

3. The device of claim 2 wherein the sailboat mast and lengthwise channels contained therein are comprised of a unitary hollow metal extrusion.

4. The device of claim 1 wherein the support links are comprised of rigid bar stock containing a hole at one end to receive the hinge pin and a hole at the other end to receive the rung pin.

5. The device of claim 1 wherein the support links are comprised of flexible cable having an eye at one end to receive the hinge pin and an eye at the other end to receive the rung pin.

6. The device of claim 1 wherein the means to retain the ladder in a raised stowed position is a rigid bar removably inserted into the bottom section of the channel bar preventing the slidable flat bar from moving downward, and latching means to retain said rigid bar in the channel bar.

7. A folding ladder device comprising:

a vertical channel bar slidably containing a substantially flat rigid bar, said flat bar containing at intervals a plurality of bracket protrusions which support a hinge pin;

a support link rotatably affixed to each said hinge pin such that each link will rotate from a stowed position within the channel bar to an extended position protruding from the channel bar;

a rigid foot rung shorter than said support links attached at one end rotatably by a rung pin to the extending end of each support link and at the other end rotatably to and within the channel bar by a fixed pin, the distance between the fixed pin attachments being more than the combined lengths of the foot rung and support link;

a stop placed within the channel bar at the base of said ladder which limits the downward vertical travel of the slidable flat bar to a distance of one foot rung length, and means to retain the ladder device in a raised stowed position.

* * * * *